US005353851A

United States Patent [19]

Cline

[11] Patent Number: 5,353,851

[45] Date of Patent: Oct. 11, 1994

[54] MATERIAL BAGGING APPARATUS

[75] Inventor: Richard W. Cline, Southport, Fla.

[73] Assignee: Grantech Technologies, Inc., Lynn Haven, Fla.

[21] Appl. No.: 118,876

[22] Filed: Sep. 9, 1993

[51] Int. Cl.[5] ..... B67C 3/26; B67C 3/34

[52] U.S. Cl. ..... 141/256; 141/98; 141/313; 141/392; 414/526; 414/487; 37/903

[58] Field of Search ..... 141/231, 10, 67, 68, 141/72, 76, 98, 114, 256, 281, 283, 284, 313-316, 392; 414/351, 353, 392, 394, 488, 489, 491, 526, 724, 487; 37/903, 409, 420, 431, 417; 241/260.1; 366/318, 320

[56] References Cited

U.S. PATENT DOCUMENTS

| | | | |
|---|---|---|---|
| 220,609 | 10/1879 | Hartley . | |
| 2,248,700 | 7/1941 | Finnell | 221/136 |
| 2,584,750 | 2/1952 | Spanski | 222/70 |
| 2,713,442 | 7/1955 | McFarling et al. | 222/238 |
| 2,792,153 | 5/1957 | Douglas, Jr. | 222/226 |
| 3,336,955 | 8/1967 | Feldman et al. | 141/72 |
| 3,552,346 | 1/1971 | Garden | 141/72 |
| 4,044,921 | 8/1977 | Caverly | 222/74 |
| 4,055,255 | 10/1977 | Vasquez | 214/2 |
| 4,184,522 | 1/1980 | Waite | 141/231 |
| 4,484,606 | 11/1984 | Kosters | 141/114 |
| 4,864,748 | 10/1989 | Boyer | 37/DIG. 3 |

*Primary Examiner*—Henry J. Recla
*Assistant Examiner*—Steven O. Douglas
*Attorney, Agent, or Firm*—Ryan, Kees & Hohenfeldt

[57] ABSTRACT

An improved material filling apparatus that can be installed in a front end multipurpose or fixed loader bucket. A hydraulic or electric motor is provided to rotate an auger, which discharges material out of a discharge opening at the one side of the device to fill sand bags or containers that are placed under this opening. In addition the front end loader will still be able to function in its normal manner when not required to fill sand bags or containers.

10 Claims, 8 Drawing Sheets

MATERIAL BAGGING APPARATUS

FIELD OF THE INVENTION

The invention relates to apparatus for filling bags with free-flowing solid materials. More particularly, the invention relates to apparatus attached or incorporated into a front-end or similar loader bucket for filling bags with sand or similar materials.

BACKGROUND OF THE INVENTION

Various devices have been proposed for filling sand bags. However, a mechanical front end loader is often required to fill the hopper of a bag filling device. Thus, such sandbag filling devices are not stand alone equipment, but instead require other equipment such front end loaders to supply material to the bag-filling component.

Examples of prior art are U.S. Pat. No. 3,552,346 issued to Garden, and U.S. Pat. No. 4,044,921, issued to Cavefly. These patents describe apparatus that require placement such that a hopper or dump truck can be filled by means of a loader.

In the formation of temporary or permanent barricades, bags filled with sand have been found to be the most expedient means of containing diverting water during a flood. Sandbags have also been used as barricades and revetments for the safety of the military personnel. Sandbags are used for construction and the prevention of erosion around culverts, river banks and numerous similar applications. In emergencies the requirement to fill large quantities of sandbags for dike or levee construction often requires many people working under severe conditions.

SUMMARY OF THE INVENTION

An important object of the invention is to provide material bagging apparatus, the installation of which does not require modification of the host vehicle. An important aspect of the invention relates to providing apparatus that fills bags with material at a high rate of speed. The invention has the capability of filling material containing particles such as stones and aggregate up to 1.5 inch and less in size to fill bags or containers.

This invention has the capability of filling bags with many types of free flowing solid materials including granular substances such as loose dirt, aggregates, stones, loose shale various types of sands, feed grains, salt pellets and pellets or granules of various chemical substances.

The invention described herein uses a front end loader as the host vehicle to which the bag filler is fitted as an attachment. The hydraulic system of the host vehicle powers the bag filling apparatus. This is in direct contrast with prior devices which use front end loaders to fill a separate material holding apparatus that subsequently fills bags. It is thus an important object of this invention to eliminate the requirement of a second piece of equipment to fill bags. A further object of the invention is to provide an attachment which can be installed in a front end loader or similar host vehicle equipped with a multipurpose bucket as few as five minutes. The present invention will permit the filling of large quantities of bags at a very rapid rate. The apparatus can be moved to locations without the use of heavy equipment.

The invention requires far fewer moving parts than prior art devices, therefore offering less potential for breakage and increased dependability. Another advantage is that the apparatus of this invention does not require an additional piece of equipment to fill the bag-filling device with material. A host front end loader in which the device of this invention is installed is employed to scoop up material to fill the bucket in the same manner as during normal operation. Due to the mobility of the front end loader, the apparatus of my invention is able to transport material directly to the area in which the material-filled bags are needed, thus speeding up the rate of providing filled bags where they are needed. Unlike prior art devices that utilize trucks, the present invention allows greater access to terrains that are difficult to traverse. A front end loader has the capability of traversing streams with several feet of water, deep mud, rough terrain, snow, and other extreme conditions. Trucks are normally limited to some type of improved surface to travel upon. Additionally the bucket will retain the ability to be utilized for normal activities when not required to fill bags.

Other objects and advantages will become apparent to those skilled in the art in view of the following description and accompanying drawings.

DETAILED DESCRIPTION OF THE PREFERRED EMBODIMENT

Figure 1:
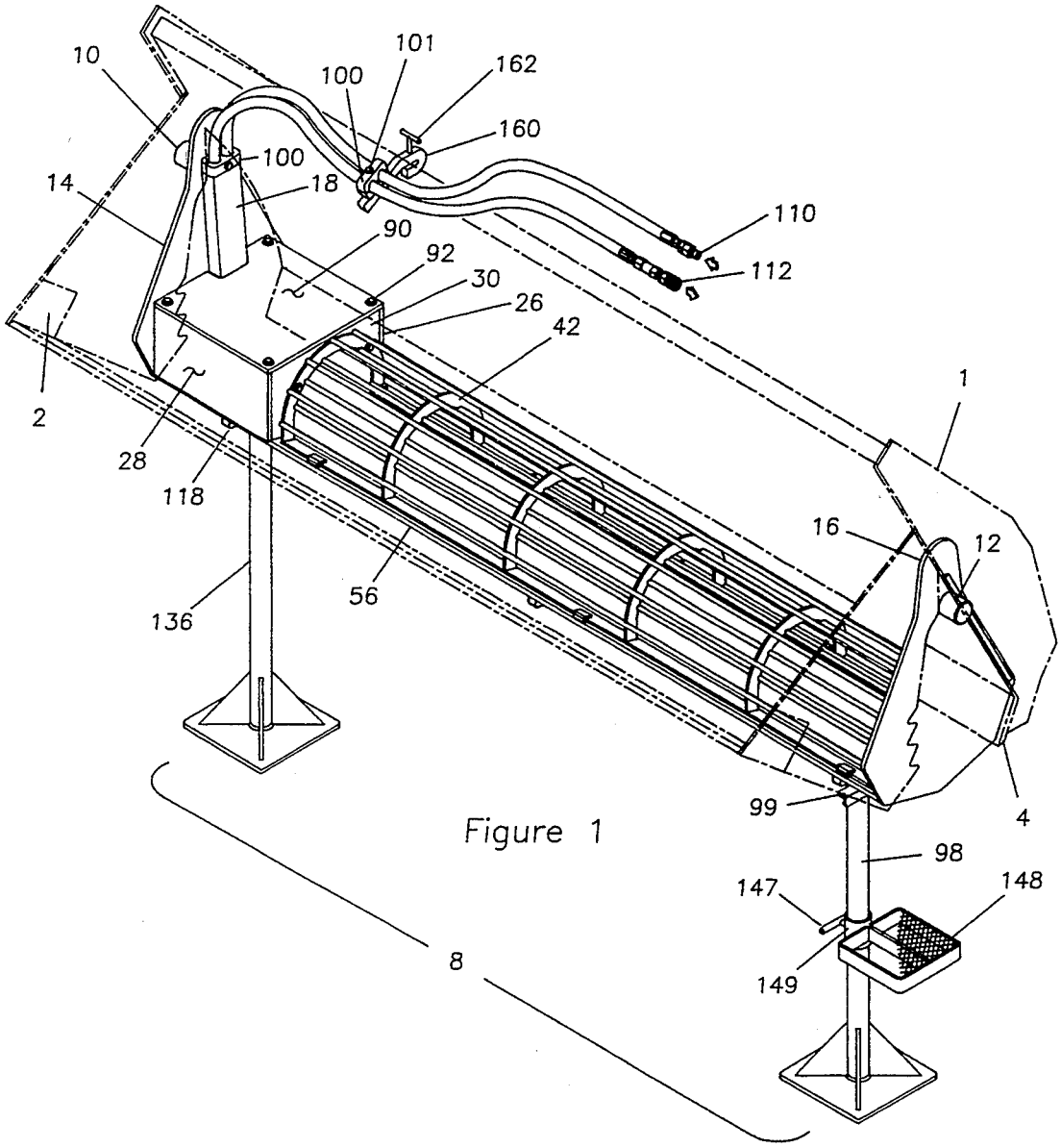
FIG. 1 is an isometric view of the material bagging apparatus within the confines of a multipurpose loader bucket, shown by phantom lines.

Referring to the drawings and particularly FIG. 1, the bagging apparatus assembly 8, is located between rear jaw 1 of a multipurpose loader bucket and bucket jaw 2. The mold board 4, is illustrated but is not a component of the material filling apparatus. The mold board 4, makes direct contact with the support feet 118 (FIG. 4) to secure the material filling apparatus within the confines of the multipurpose loader bucket 1, 2.

Figure 2:
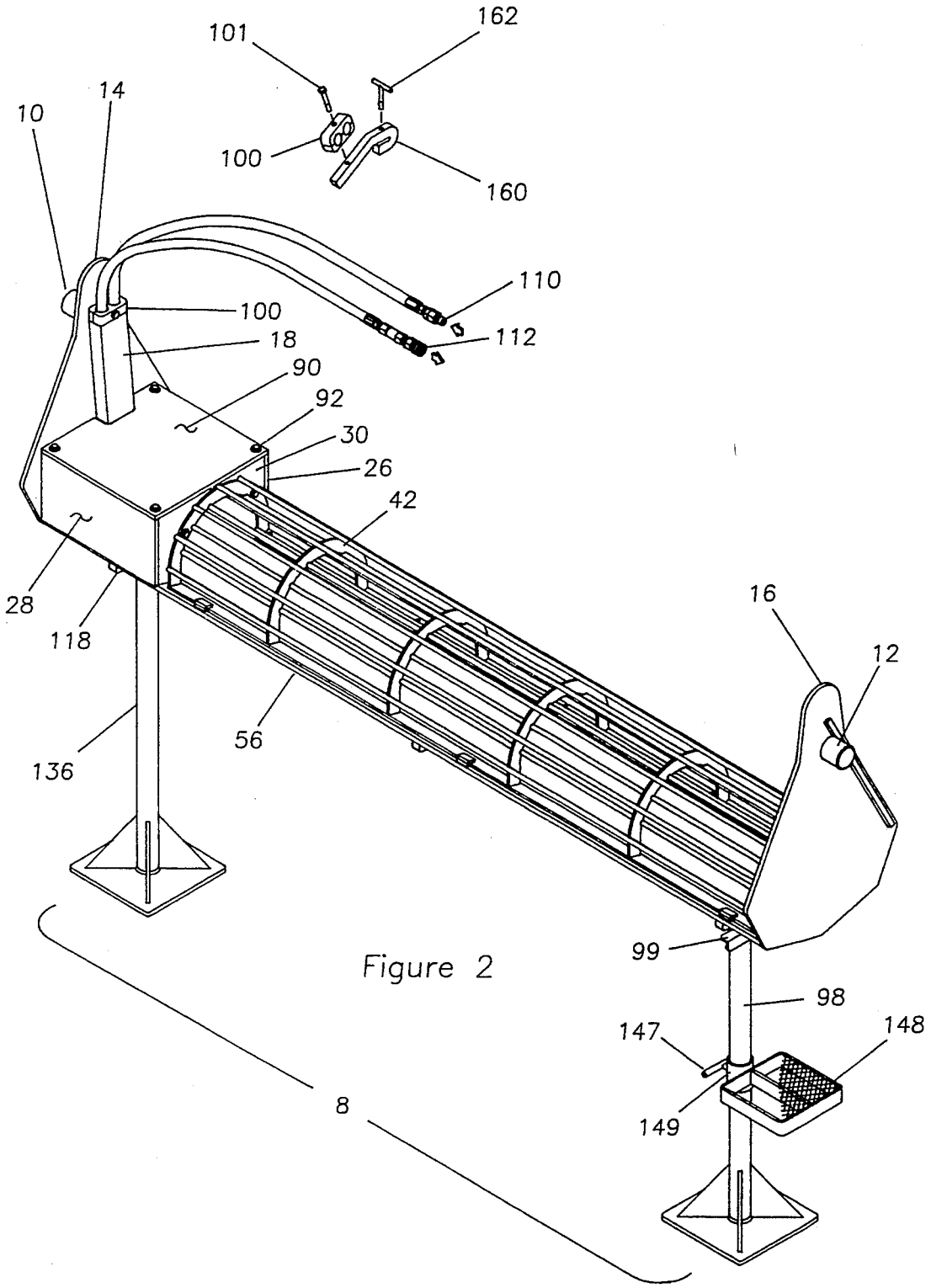
FIG. 2 is an isometric view of the material filling apparatus.

Referring to FIG. 2, the main support plate 56, forms a base for all other components. The right end plate 14, and left end plate 16, form the ends of bagging apparatus assembly 8. The guide pin right 10, and guide pin left 12, are centering guides for the bagging apparatus assembly 8. Rock guard 42 is comprised of multiple steel rods welded to circular supports thus forming a semi circle running parallel to the main support plate 56. The hose support 160, formed to fit over the lip of the multipurpose loader bucket 1, is held in place by T-handle support 162. Hose clamp 100, is attached to the hose support 160 by means of a fastener 101.

Figure 3:
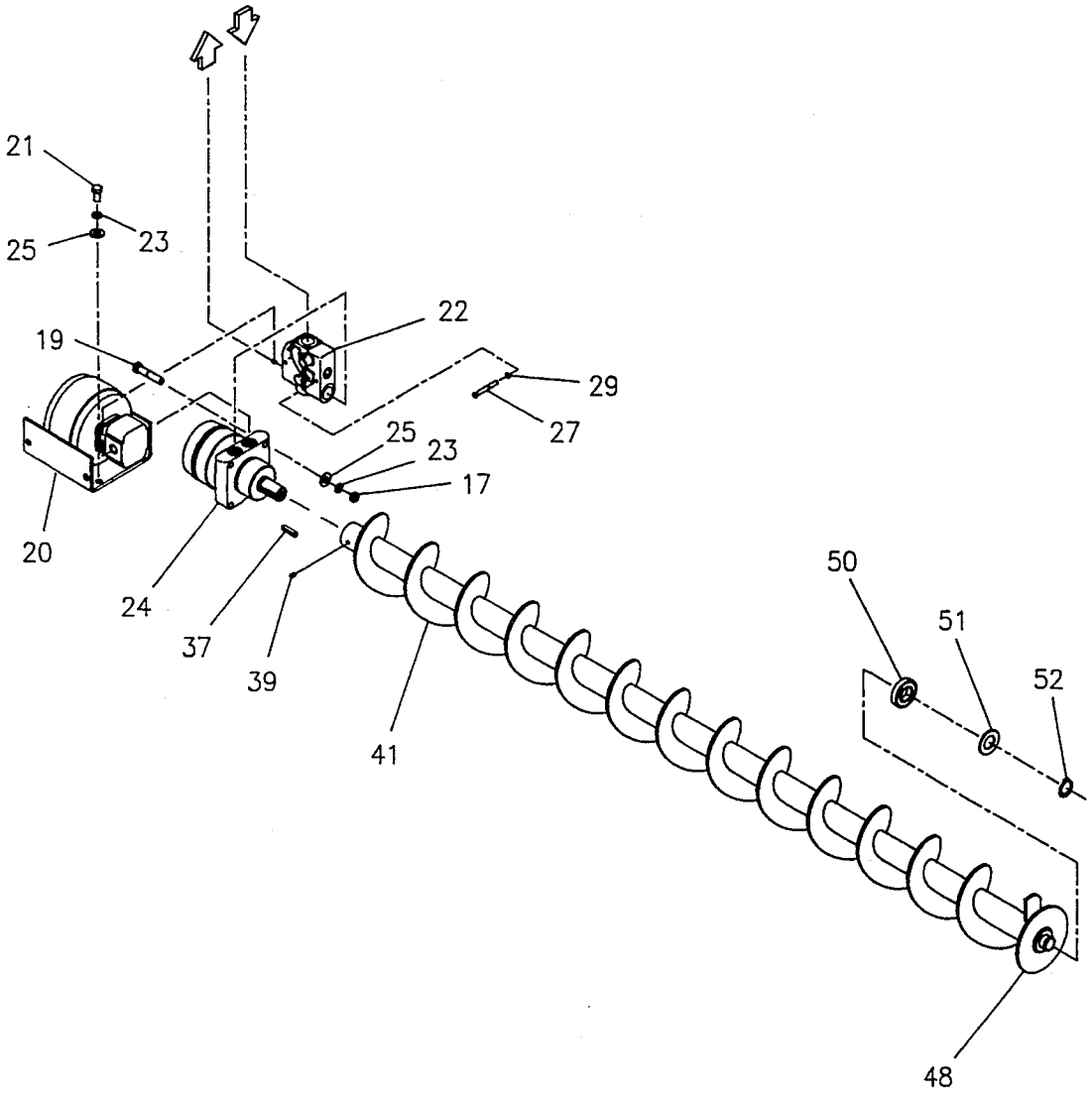
FIG. 3 is an isometric view of the auger and hydraulic componentry.

Referring to FIGS. 2 and 3, auger 41 runs within the confines of rock guard 42 which is in the form of a metal cage. The diffuser ring 48 is a steel ring of a diameter equal to that of auger 41, and is welded in place. Ball bearing 50 is designed to rotatably support the outboard end of the auger shaft 41. The bearing 50 is retained by a washer 51 and snap ring retainer 52. Hydraulic motor 24, is provided with an output shaft slotted to accept a key 37. The auger 41 is designed to receive the aforementioned output shaft and key 37. The shaft of auger 41 is machined to accept the hydraulic motor 24 output shaft with a close tolerance fit. A set screw 39 with a recessed drive socket secures auger 41 to the output shaft.

Figure 4:
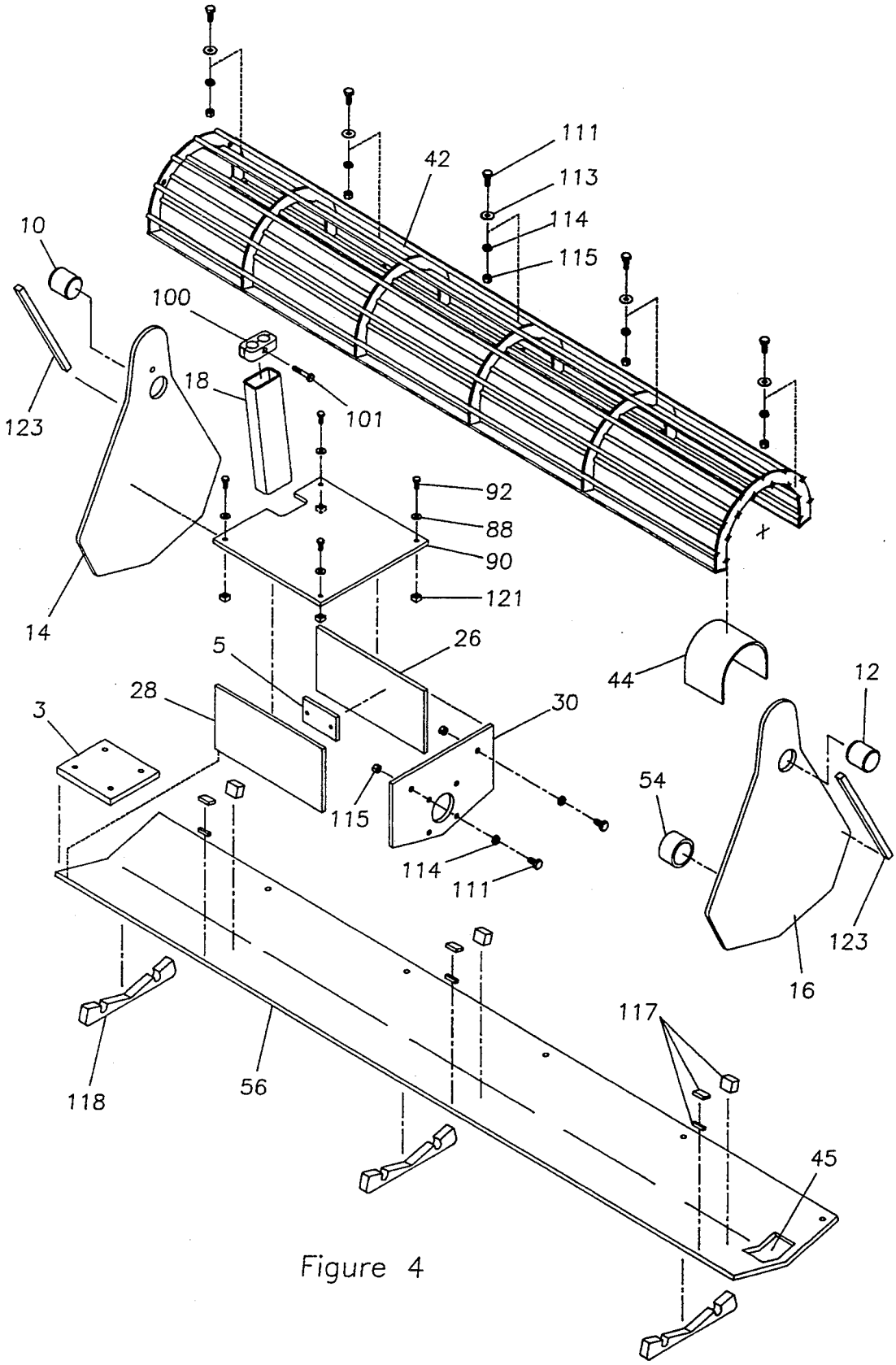
FIG. 4 is an exploded isometric view of the sections which form the mounting surfaces for the hydraulic components, auger assembly and the material bagging apparatus.

Referring to FIG. 4, three evenly spaced support feet 118 are welded to the bottom of main support plate 56, and are solid steel for strength. Three rockguard retainers 117 are welded to the upper forward surface of the main support plate 56, and forth L-shaped lips when in place. A vibrator mounting plate 3, is welded to the upper surface of the main support plate 56 opposite bearing support 54.

The vibrator mounting plate 3 is pre-drilled with four threaded holes. The bearing support 54, is of machined steel stock and is welded to the inboard side of the left end plate 16. Spacers 123 are welded to the outboard sides of the left end plate 16 and right end plate 14. The rear enclosure plate 26, and the front enclosure plate 28, are welded perpendicularly to the ends of hydraulic motor mounting plate 30. This assembly is then welded to the right end plate 14 forming an enclosure. The enclosure is welded to the mating surface of the main support plate 56. The control valve mounting plate 5 is steel stock with pre-drilled and threaded holes and is welded to the rear enclosure plate 26. The motor enclosure top plate 90, is rigid steel with four pre-drilled holes and is notched at the outboard side to accept the hose guide 18, which is steel channel. Fastener 92 passes through lock washer 88 and the motor enclosure top plate 90, which prevents foreign material from entering the hydraulic component containment area.

Welded to the inboard surface of the rear enclosure plate 26, is a control valve mounting plate 5. This mounting plate 5 provides a mounting surface for the control valve 22, FIG. 5. The vibrating mounting plate 3 is welded to the main support plate 56 within the hydraulic component enclosure for the purpose of mounting a vibrator motor 20, FIG. 5, and to transmit vibratory forces throughout the material bagging apparatus assembly 8 and loader bucket 1, 2. Vibrator motor 20 includes means to cause an eccentric shaped body to rotate thereby causing the motor to vibrate constantly to prevent sand and soil from adhering cohesively to the frame.

The discharge guide 44 is a preformed steel semi annulus welded to the inboard side at the base of the left end plate 16, and the mating surface of main support plate 56. The discharge aperture 45 is a hole centered below the discharge guide 44. The rock guard mounting fasteners 111 pass through washer 113 and then through pre-drilled holes in rock guard 42 and in main support plate 56 and are secured by lock washers 114 and nuts 115. There are five sets of fasteners performing this function in the illustrated embodiment.

Figure 5:
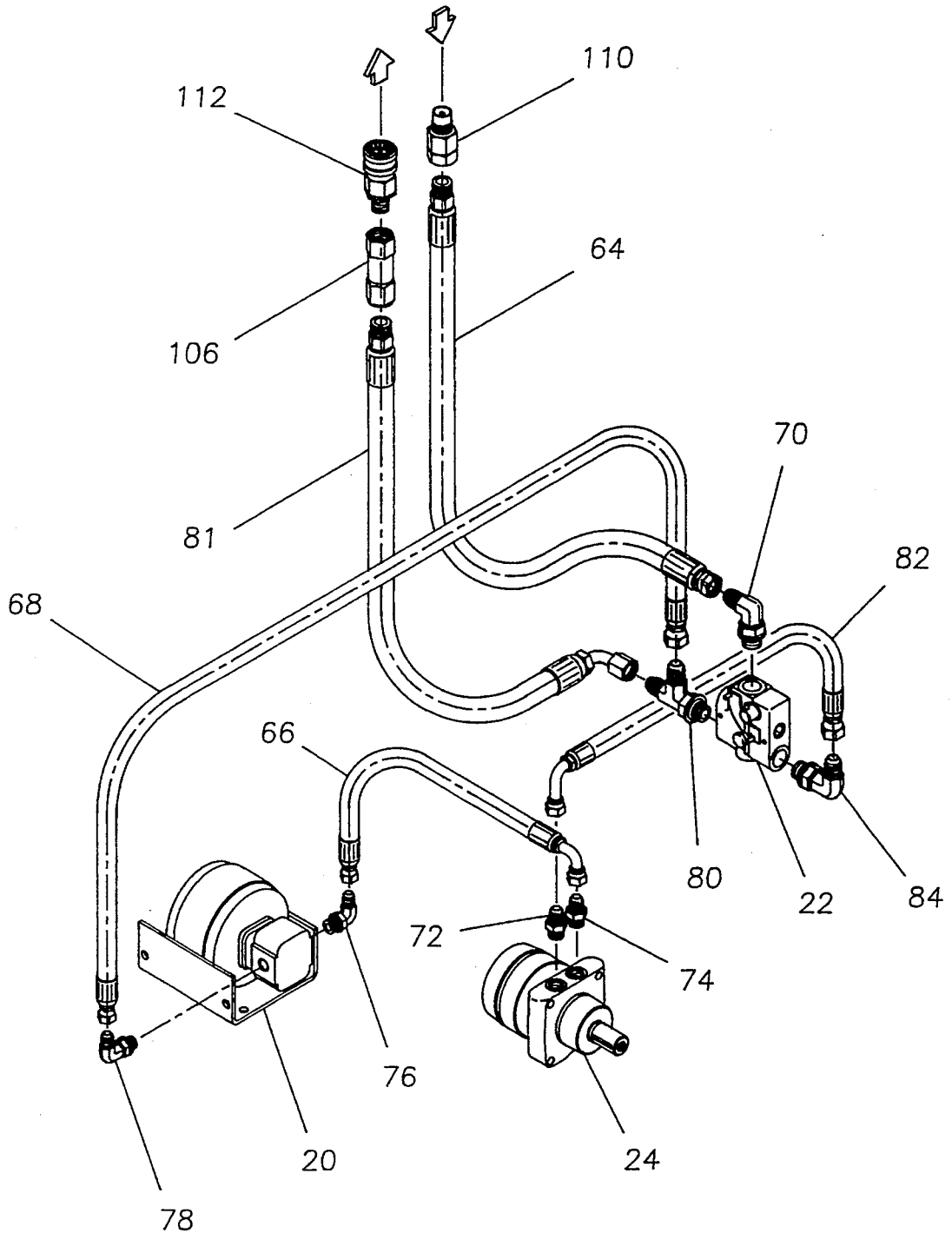
FIG. 5 is a isometric view of the apparatus hydraulic system.

Referring to FIG. 5, in a preferred embodiment, the quick disconnect coupling 110 is a standard 1 or 1¼ inch hydraulic coupler. In a preferred embodiment all hoses fittings and couplings are approximately 1¼ inch inside diameter rated to withstand the pressures encountered, for example, 4,000 PSI. The quick disconnect inlet coupling 110 is threaded onto hose 64 which is in turn threaded to an elbow 70. A hydraulic control valve 22 controls hydraulic pressure and flow rate.

Elbow fitting 84 is attached to the outlet of the control valve 22. A hose 82 transmits hydraulic power to motor through inlet nipple 72 which is coupled to motor 24. Fitting 74 couples motor 24 to hose 66 which is coupled by an elbow 76 to an inlet opening in vibrator motor 20. Elbow 78 connects a return hose 68 to the vibrator motor 20. Hose 68 couples the vibrator motor 20 to a T-fitting 80 which is coupled to the control valve 22. Return hose 81 couples the T-fitting 80 to a check valve 106. Check valve 106 is coupled to quick disconnect return 112. The check valve 106 is in the hydraulic circuit to prevent hydraulic oil from flowing in the reverse direction which could damage the hydraulic components. The quick disconnect 112 is coupled to the check valve 106 and provides a means of connecting the hydraulics to the host vehicle hydraulic system.

Referring to FIG. 3, fastener 27 passes through lock washer 29, then passes through control valve 22 securing it to the control valve mounting plate 5, FIG. 4. Fastener 19 passes through the hydraulic motor 24 pre-drilled holes of which there are four, and then through mounting plate 30, FIG. 4, and is secured by a flat washer 25, a lock washer 23, and a nut 17. Fastener 21 connects vibrator motor 20 to plate 3.

Figure 6:
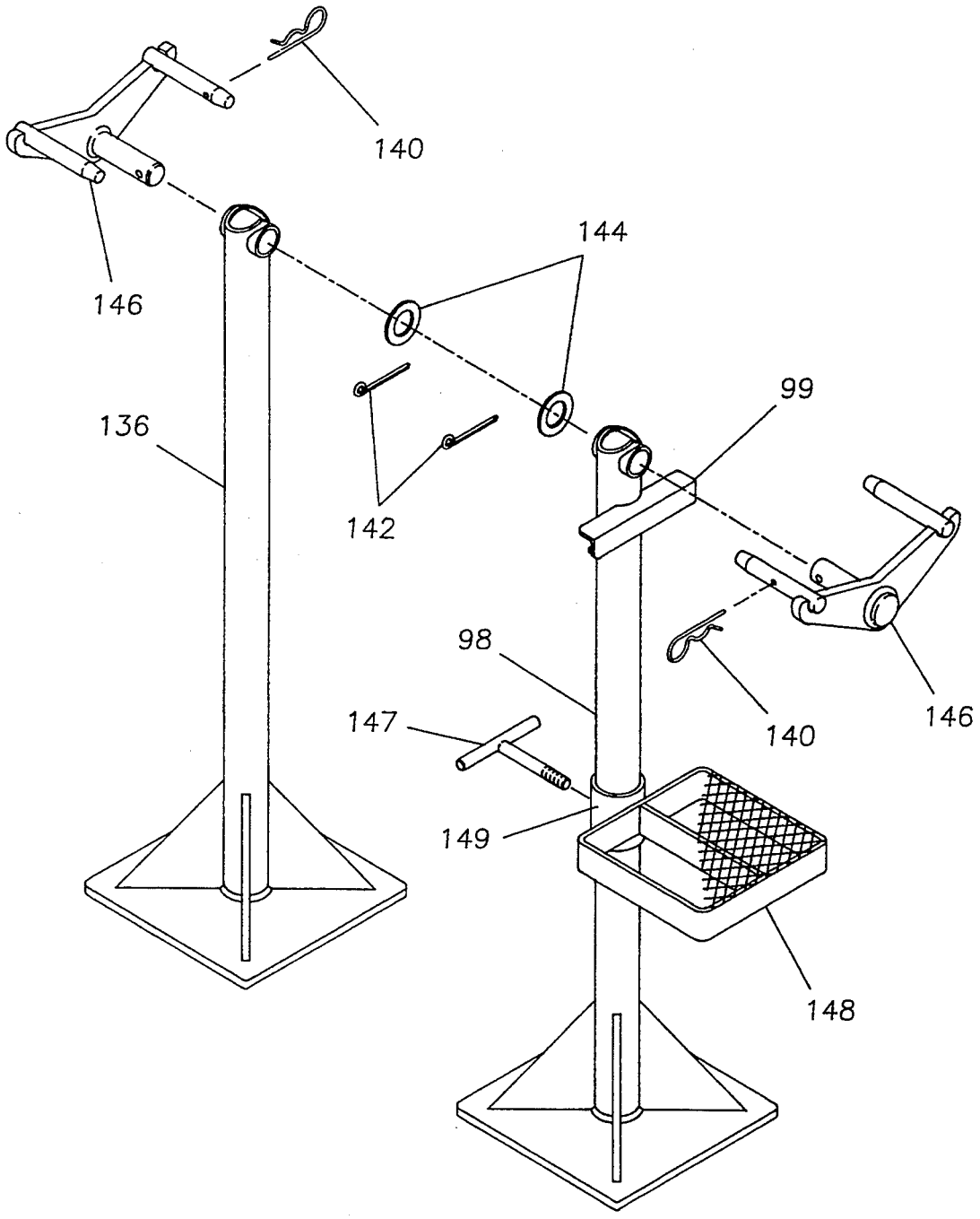
FIG. 6 is an isometric view of the safety support stands and bag rest.

Referring to FIG. 6, the safety stand 136 is a rigid steel tube (for example, 2.5 inches in diameter with a 1 square foot base) and a hole at the top to allow pin 146 to pass through it. Center pin is preferably about 1 inch in diameter with pre-drilled holes to accept cotter pin 142 which, when in place, will retain the washer 144 and the safety stand 136. A similar stand 98 is provided at the opposite end of the device and is provided with a bag hook 99 which can be a preformed angle welded to the upper portion of the stand 98. The safety stand 98 also incorporates a bag support 148, which may consist of a steel frame supporting expanded light weight steel. A collar 149 which may consist of a steel tube with an inner diameter sized to permit the collar 149 to pass over the outer diameter stand 98. The bag support 148 is welded to collar 149. Collar 149 has a threaded hole opposite the weld to accommodate a T handle 147 which may be a ½ inch steel stock with threads to secure the collar 149 to the stand 98. Stands 98 and 146 are attached to the bottom of assembly 8 by means of adapters 146, each of which has two smaller diameter steel rods which pass through pre-manufactured groves in support feet 118. The adapters are held in place by hairpins 140 which pass through the pre-drilled holes in the small diameter rods on the inward side of support feet 118.

Figure 7:
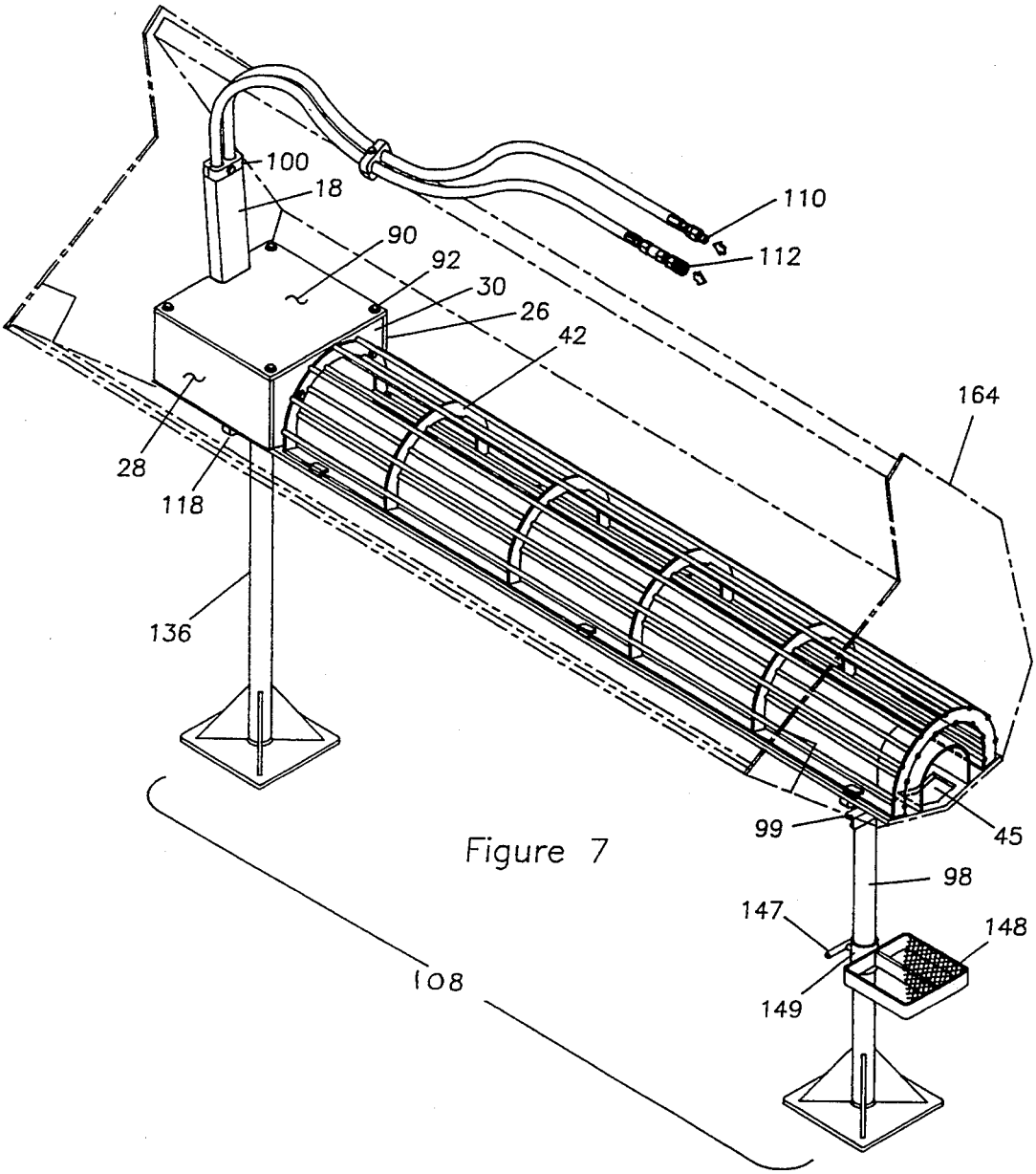
FIG. 7 is an isometric view of the material bagging apparatus within the confines of a simple one-piece loader bucket, shown by phantom lines.
Figure 8:
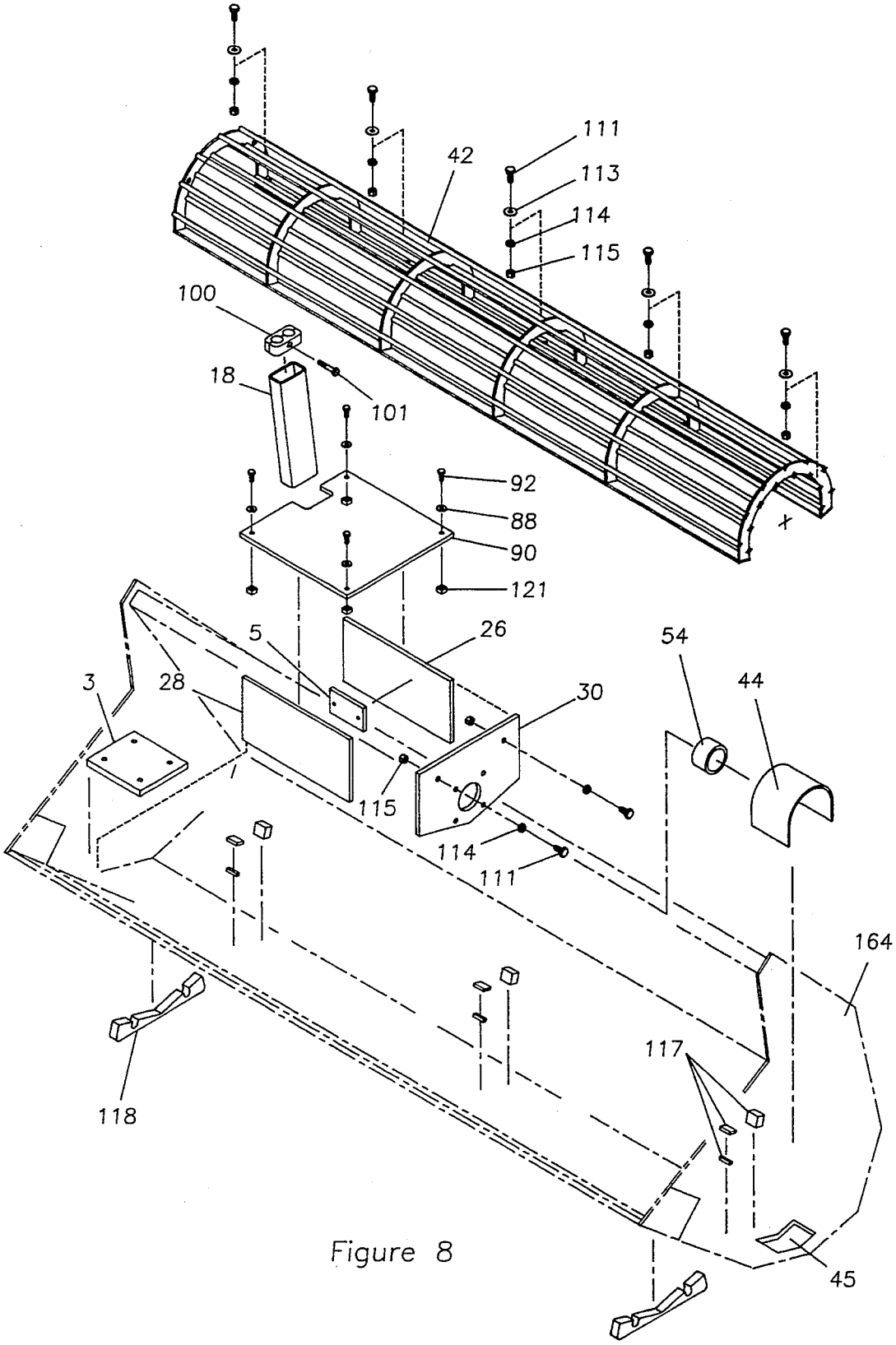
FIG. 8 is an exploded isometric view of the apparatus of FIG. 7.

The foregoing preferred embodiment shows a device that is usable as an attachment for a multi-purpose loader. In the case of a loader having a one-piece bucket, as shown in FIGS. 7 AND 8, the assembly 8 can be incorporated into a bucket that is used to replace the existing bucket on the loader. While the time required for mounting the device on the loader is greater in that case, the benefits of the invention can be thus achieved without the need for acquisition of a compound or multi-purpose bucket.

A one-piece or fixed bucket 164 is modified by cutting a discharge opening 45 through the bottom of the bucket 164 near one end as seen in FIGS. 7 and 8. Assembly 108 is attached by welding bearing support 54, discharge guide 44, and the ends of rear enclosure plate 26 and front enclosure plate 28 to the interior of bucket 164. Two support feet 118 are welded to the exterior bottom of bucket 164 as shown. The remainder of the components are similar to those shown in FIGS. 1–6.

While hydraulic motors 20 and 24 and hydraulic hose connections have been shown by way of example, auger 41 and a suitable vibrator can be driven by means of alternative drive mechanisms, instead. For example, an electric motor driven by electrical power supplied through appropriate insulated conductive wires can be used in place of hydraulic motors 20 and 24.

OPERATION

Referring the drawings and particularly FIG. 2, the material filling apparatus fits within the confines of a front end loader equipped with a multipurpose bucket illustrated in FIG. 1. The bucket jaw 2 is conventionally opened by two hydraulically operated cylinders. The host vehicle, is equipped with a multipurpose bucket which is placed over the material filling apparatus 8 and lowered, thereby encompassing the apparatus. After the multipurpose bucket is lowered to ground level, the bucket jaw 2 is closed engaging the forward leading edge of the main support plate 56 and the support feet 118.

Material received in the filling apparatus is diverted to the discharge opening 45 by means of auger 41 which is rotated by hydraulic motor 24. Hydraulic pressure and fluid flow to power the motor is supplied from the on board hydraulic system of the host vehicle. Discharge aperture 45 permits the displaced material to fall free from the assembly into a bag placed below the aperture. The invention is equipped with a bag rest 148 which supports the bag during the filling operation. Vibrator motor 20 is designed to shake the bucket assembly to prevent the material from becoming solid or clumping, thus allowing the material to flow freely down through the rock guard 42 toward the auger 41.

Referring to FIG. 2, the main support plate 56, is welded to the right end plate 14, and left end plate 16. The rear enclosure plate 26, the front enclosure plate 28, and the hydraulic motor mounting plate 30 form an enclosure for the hydraulic components. The bag filling apparatus 8 is employed with front end loaders fitted with a multipurpose bucket assembly. A multipurpose bucket assembly consists of a rear section 1 and a front section 2. To ensure proper engagement, guide pins 10 and 12 direct the material filling apparatus 8 to a vertical position, as the multipurpose bucket is lowered in place.

Referring to FIG. 3, the auger 41 functions to displace material by its spiral flutes affixed to the center shaft. The diffuser ring 48 is affixed to the end of the auger shaft 41 to prevent material from contaminating the race of bearing 50. The bearing 50, which is outboard of the diffuser ring 48, maintains a true alignment and ease of rotation for the auger 41. The bearing 50 is inserted into the bearing support 54, FIG. 4, which secures the bearing 50 in place.

Referring to FIG. 4, the rock guard 42 is installed over the auger 41, to prevent oversize material from damaging the auger 41. A secondary purpose of the rock guard 42 is to prevent operators from coming in contact with the auger 41.

The mounting surfaces and containment of the hydraulic components are formed by the welding of the rear enclosure plate 26, the hydraulic motor mounting plate 30, and the front enclosure plate 28. The discharge guide 44 is located and welded on the left end plate 16 to act as a guide the material being displaced by the auger 41. The spacer 123 is placed and welded to the right end plate 14, and left end plate 16, to fill a void that occurs when the multipurpose loader bucket 1 and the bucket jaw 2 engage the opposite sides of the material bagging apparatus, thus preventing material from exiting the confines of the multipurpose loader bucket. The support feet 118 provide a level attitude of the assembly to permit ease of installation into the multipurpose loader bucket 1. In addition the support feet 118 provide mounting surfaces for the adapter 146.

Referring to FIG. 5, the quick disconnect 110 permits a union between the material bagging apparatus 8 assembly and the host vehicle. This type connection prevents contaminants from entering the hydraulic system when connected or disconnected. The hose pressure valve 64 directs hydraulic oil to the control valve hydraulic 22. The control valve 22 provides a means of controlling the hydraulic flow rate to the operational motors down stream within the circuit. Hose 82 directs hydraulic oil to the inlet side of the hydraulic motor 24.

The stands 98 and 136 are supported on the multipurpose loader bucket above the ground during the material filling apparatus operation and act as safeguards to prevent the loaded bucket from falling on the operator in the event of equipment failure. The aforementioned stands are pivotally secured by means of the two adapters 146. The central, largest pin of adapter 146 is inserted through the hole at the top of the aforementioned stands. The pivotal connection permits the stands 146 to hang perpendicularly by natural gravity forces. The foot assemblies are installed on the support feet 118 by inserting the two smaller pins of the adapter 146 into the two machined groves provided. The assemblies are installed on the two outer support feet 118 after the multipurpose loader bucket 1, 2 has been filled with material by the host vehicle and is ready for operation. During the operation of the invention, the operator on the ground places the container(s) on the bag support 148. Should the container be a pliable bag, he will place a section of the bag under and behind bag hook 99, to assist in holding it in place for the material to fall into it as described above. The purpose of the T handle 147 is to permit the operator to raise and lower as necessary the bag support 148 to accommodate different size containers.

Also, while the use of a front end loader on a tractor is described, it will be apparent that any type of construction equipment to which a similar bucket is attached and operated can be used in connection with the practice of the invention.

The flow of sand to a bag or other container is started and stopped by starting and stopping motor 24, and hence the rotation of auger 41. This can be accomplished in a two-man operation by having a person filling the bags nod his head or otherwise signal to a tractor operator indicating when to start and stop the turning of the auger. Other means can optionally be provided for controlling the flow of materials. For example, the bagging operator can directly control the flow of materials either by activating a hand or foot operated control lever provided at the bagging station. If desired, a means such as a pivoting or sliding door or doors can be used to open and close aperture 45. The use of such expedients, however, has not generally been found to be necessary.

It is, thus, seen that the material filling apparatus of this invention provides a highly reliable, very rapid device which can fill large quantities of bags and containers. It can fill the bags and containers with semi cohesive materials or aggregate up to 1.25 inch in diameter. It contains a very small amount of moving parts, making it very durable and easy to use.

Although the description above contains many specificities, these should not be construed as limiting the scope of the invention, but as merely providing illustrations of some of the presently preferred embodiments of this invention. Thus, the scope of the invention should be determined by the appended claims and their legal equivalents, rather than by the examples given.

What is claimed is:

1. Apparatus for filling containers from a bucket assembly having front and rear jaws defining an interior chamber therebetween comprising an attachment adapted to be secured within the interior chamber of the bucket assembly for receiving free flowing solid material, said bucket assembly including means to transmit power to the attachment, said attachment including a rotatable auger having a distal and a terminal end for conveying said free flowing materials along its rotational axis toward its distant end and means for rotating said auger, said rotating means being attachable to said means to transmit power, said auger being supported on a base plate located below said auger and upstanding end members located at the opposite ends of said base plate, said end members being provided with openings that rotatably support said auger, said base plate being provided with a discharge opening adjacent to the distal end of said auger and adjacent to one of said upstanding end members and a cage defining an enclosure enclosing said auger, said cage being provided with openings to screen the size of said materials entering said enclosure.

2. Apparatus according to claim 1 further comprising a vibrator that includes an eccentric rotatable body and means to rotate said body thereby causing said apparatus to vibrate to prevent said free flowing materials form adhering cohesively.

3. Apparatus according to claim 1 wherein said bucket assembly is part of a front end loader attached to a tractor supplied with hydraulic power and said rotating means includes a hydraulic motor for rotating said auger.

4. Apparatus according to claim 1 wherein said cage is formed by a plurality of parallel longitudinal members supporting a plurality of shorter transverse members.

5. Apparatus for filling containers from a bucket assembly comprising an attachment adapted to be secured within said bucket assembly for receiving free flowing solid material, said bucket assembly including means to transmit power to the attachment, said attachment including a rotatable auger having a distal and terminal end for conveying said free flowing materials along its rotational axis toward its distal end and means for rotating said auger, said rotating means being attachable to said means to transmit power, said auger being supported on a base plate located below said auger and upstanding end members located at the opposite ends of said base plate, said end members being provided with openings that rotatably support said auger, said base plate being provided with a discharge opening adjacent to the distal end of said auger and further comprising safety stands attached at each end of said attachment for supporting the apparatus above the ground in the event of equipment failure.

6. Apparatus according to claim 5 wherein a support for a bag is attached to one of said stands adjacent said discharge opening to support bags during discharge of material into said bags.

7. Apparatus for filling sand bags from a bucket having a terminal and distal end defining an interior chamber comprising an attachment for front end loader assembly on a host vehicle, said front end loader assembly being provided with said bucket adapted to scoop and receive free flowing solid material, said host vehicle including a source of power and means to extend said power to the attachment, said attachment including a rotatable auger, adapted to be secured within said interior chamber, having a distal and terminal end at each end of said chamber, respectively, for conveying said free flowing materials along its rotational axis toward its distal end, a motor attached to said auger for rotating the same, said motor being connected to said source of power, said auger being contained in an enclosure formed by a base plate located below said auger and upstanding end plates connected to opposite ends of said base plate, said end plates being provided with openings that rotatably support said auger, said base plate being provided with a discharge opening adjacent to the distant end of said auger, and a cage defining an enclosure enclosing said auger, said cage being formed by a plurality of parallel longitudinal members supporting a plurality of shorter transverse member forming openings to screen the size of said materials entering said enclosure.

8. Apparatus according to claim 7 wherein said motor is a hydraulic motor.

9. Apparatus according to claim 7 wherein said bucket is detachable and said end plates and said base plate comprise the ends and the bottom of a one-piece fixed loader bucket, respectively.

10. Apparatus according to claim 7 wherein said base plate is welded to said end plates and said plates are adapted to be secured within the interior chamber formed by the front and rear jaws of a compound loader bucket.

* * * * *